US010036130B2

(12) United States Patent
Tokuno

(10) Patent No.: US 10,036,130 B2
(45) Date of Patent: Jul. 31, 2018

(54) SLAB BRIDGE STRUCTURE

(71) Applicants: ASAHI ENGINEERING CO., LTD., Ishikawa (JP); AE JAPAN CO., LTD., Ishikawa (JP)

(72) Inventor: Mitsuhiro Tokuno, Ishikawa (JP)

(73) Assignees: ASAHI ENGINEERING CO., LTD., Ishikawa (JP); AE JAPAN CO., LTD., Ishikawa (JP)

( * ) Notice: Subject to any disclaimer, the term of this patent is extended or adjusted under 35 U.S.C. 154(b) by 0 days.

(21) Appl. No.: 15/518,935

(22) PCT Filed: Oct. 17, 2014

(86) PCT No.: PCT/JP2014/077692

§ 371 (c)(1),
(2) Date: Apr. 13, 2017

(87) PCT Pub. No.: WO2016/059722

PCT Pub. Date: Apr. 21, 2016

(65) Prior Publication Data

US 2017/0233961 A1 Aug. 17, 2017

(51) Int. Cl.
*E01D 19/02* (2006.01)
*E01D 19/12* (2006.01)
(Continued)

(52) U.S. Cl.
CPC ..... *E01D 19/125* (2013.01); *E01D 2/02* (2013.01); *E01D 19/02* (2013.01); *E01D 21/00* (2013.01);
(Continued)

(58) Field of Classification Search
CPC ..... E01D 1/00; E01D 12/00; E01D 19/00; E01D 19/005
(Continued)

(56) References Cited

U.S. PATENT DOCUMENTS 4,660,243 A * 4/1987 Kinkel ..... E01D 21/00 14/74.5
7,469,439 B2 * 12/2008 Tokuno ..... E01D 2/00 14/73
(Continued)

FOREIGN PATENT DOCUMENTS

JP 5-79017 3/1993
JP 9-71904 * 3/1997
(Continued)

OTHER PUBLICATIONS

International Search Report dated Jan. 13, 2015 in International Application No. PCT/JP2014/077692.

*Primary Examiner* — Gary S Hartmann
(74) *Attorney, Agent, or Firm* — Wenderoth, Lind & Ponack, L.L.P.

(57) ABSTRACT

A slab bridge structure having improved rigid connection strength between bridge girders and concrete piers. The slab bridge structure has a rigid connection structure in which slab concrete (3) is poured between side surfaces of bridge girders (1) arranged in line in a bridge width direction, throughout a longitudinal direction of the bridge girders, connection concrete (12) in which bridge girder portions (1') supported by a bridge seat (2*a*) of a concrete pier (2) that supports the bridge girders are embedded is further added onto the bridge seat, and the slab concrete and the concrete pier are concrete-joined through the connection concrete, the slab bridge structure further includes: a connecting rod (13) embedded in the concrete pier and projecting upward from the bridge seat of the pier; and a connecting plate (14) connecting upper end portions of the adjacent bridge girder portions.

9 Claims, 18 Drawing Sheets

(51) Int. Cl.

| | |
|---|---|
| ***E01D 2/02*** | (2006.01) |
| ***E01D 21/00*** | (2006.01) |
| *E01D 101/26* | (2006.01) |
| *E01D 101/30* | (2006.01) |

(52) U.S. Cl.
CPC ..... *E01D 2101/26* (2013.01); *E01D 2101/30* (2013.01)

(58) Field of Classification Search
USPC ..... 14/73, 74.5, 75, 78
See application file for complete search history.

(56) References Cited

U.S. PATENT DOCUMENTS

| | | | | |
|---|---|---|---|---|
| 2006/0137115 | A1* | 6/2006 | Park | E01D 2/02 14/74.5 |
| 2007/0251031 | A1 | 11/2007 | Tokuno et al. | |

FOREIGN PATENT DOCUMENTS

| | | | |
|---|---|---|---|
| JP | 2000-319816 | | 11/2000 |
| JP | 2003-306908 | | 10/2003 |
| JP | 2005-240503 | | 9/2005 |
| JP | 2007-211566 | * | 8/2007 |
| JP | 4318694 | | 8/2009 |

* cited by examiner

SLAB BRIDGE STRUCTURE

TECHNICAL FIELD

The present invention relates to a slab bridge structure in which a slab made by pouring slab concrete between side surfaces of bridge girders arranged in line in a bridge width direction, throughout a longitudinal direction of the bridge girders, is rigidly connected with concrete piers.

BACKGROUND ART

As a conventional slab bridge structure, as described in Patent Literature 1, a slab bridge structure is known, in which a rigid connection structure is formed by pouring slab concrete between side surfaces of bridge girders arranged in line in a bridge width direction, throughout a longitudinal direction of the bridge girders, to form a slab made of a composite structure of the bridge girders and the slab concrete, further adding connection concrete, in which the bridge girder portions supported by bridge seats of concrete piers that support the bridge girders are embedded, onto the bridge seats, and concrete-joining the slab concrete and the concrete piers through the connection concrete.

Further, the slab bridge structure discloses, as means to reinforce a concrete joining structure with the connection concrete, a structure to insert connecting rods, which are embedded in the concrete piers and project upward from the bridge seats of the piers, into the bridge girder portions supported by the bridge seats, connect the bridge girder portions, and embed the connecting rods and the bridge girder portions in the connection concrete.

CITATION LIST

Patent Literature

Patent Literature 1: JP 4318694 B

SUMMARY OF INVENTION

Technical Problem

The slab bridge structure of Patent Literature 1 employs the structure to concrete-join the slab concrete and the concrete piers through the connection concrete, and to reinforce the concrete joining with the connecting rods that directly connect the concrete piers and the bridge girder portions supported by the piers.

According to the slab bridge structure of Patent Literature 1, rigid connection strength between the bridge girders and the concrete piers by the slab concrete and the connection concrete can foe remarkably improved, and strength of the connection concrete itself can be increased in an interactive manner.

The present invention provides a slab bridge structure that enables more easy and reliable connecting between concrete piers and bridge girder portions supported by the piers with a structure different from the structure of Patent Literature 1, while employing a rigid connection structure between the bridge girders and the concrete piers by slab concrete and connection concrete, similar to Patent Literature 1, and reinforces the rigid connection structure.

Solution to Problem

In essence, a slab bridge structure according to the present invention is assumed to have a rigid connection structure in which slab concrete is poured between side surfaces of bridge girders arranged in line in a bridge width direction, throughout a longitudinal direction of the bridge girders, connection concrete in which bridge girder portions supported by a bridge seat of a concrete pier that supports the bridge girders are embedded is further added onto the bridge seat, and the slab concrete and the concrete pier are concrete-joined through the connection concrete, similarly to the structure of Patent Literature 1. The present invention further employs the next structure.

That is, the slab bridge structure further includes a connecting rod embedded in the concrete pier and projecting upward from the bridge seat of the pier, and a connecting plate connecting upper end portions of the adjacent bridge girder portions, and the slab bridge structure is configured to have the bridge girders connected with the concrete pier by inserting a projection portion of the connecting rod into the connecting plate, providing a stopper to an upper-end projection portion of the connecting rod inserted in the connecting plate, and fastening the stopper to an upper surface of the connecting plate. The connecting rod and the connecting plate are connected with the concrete pier that supports the bridge girder portions while connecting the bridge girder portions in the bridge width direction to reinforce the rigid connection structure. As the stopper, a nut can be used, and the nut is screwed onto the upper-end projection portion of the connecting rod and is fastened to the bridge girder portion to be targeted.

Further, the upper end portions of the bridge girder portions of all the bridge girders are connected through the connecting plate, whereby the connecting plate is connected with the concrete pier while connecting all the bridge girders arranged in line in the bridge width direction to reinforce the rigid connection structure.

Further, the upper end portion of the bridge girder portion of the bridge girder is connected with the upper end portion of at least one another bridge girder portion through the connecting plate, whereby the bridge girder portions can be connected with the concrete pier while being connected in the bridge width direction in a minimum necessary manner.

Preferably, one end portion of the connecting plate is fit with the upper end portion of one adjacent bridge girder portion, and the other end portion of the connecting plate is fit with the upper end portion of the other adjacent bridge girder portion, to connect the upper end portions of the adjacent bridge girder portions, whereby the solid and rigid connection structure can be built while absorbing shift of the bridge girders in the bridge length direction.

Further, a first flange is installed in a protruding manner in one end portion of the connecting plate and is engaged with the upper end portion of one adjacent bridge girder portion, and a second flange is installed in a protruding manner in the other end portion of the connecting plate and is engaged with the upper end portion of the other adjacent bridge girder portion, to connect the upper end portions of the adjacent bridge girder portions and to promptly and reliably connect the bridge girder portions in the bridge width direction.

Further preferably, lower end port ions of the bridge girder portions connected with the connecting plate is connected with an auxiliary connecting plate, and the connecting rod is inserted into the auxiliary connecting plate, whereby the bridge girder portions can be reliably and firmly connected at the upper and lower end portions.

In the present invention, the concrete pier is stood on a buried pile, or sheet piles are knocked into the ground while joined with one another, facing the bank, to build an earth-retaining wall, which is continuously formed in the bridge width direction, and the concrete pier is supported by upper ends of the sheet piles projecting above water or ground, whereby a rigid connection structure that concrete-joins the pier and the slab concrete with the connection concrete is built.

The bridge girders are directly supported by the bridge seat of the concrete pier or indirectly supported by the sleeper provided on the bridge seat, and the sleeper is embedded in the connection concrete. As the sleeper, a concrete sleeper poured and formed on the bridge seat of the concrete pier or steel material can be used.

In the present invention, an abutment and a pier are collectively referred to as the term "pier".

Advantageous Effects of Invention

According to the present invention, the slab concrete and the connection concrete form the portal rigid frame structure in cooperation with each other, and the structure can remarkably improve rigid connection strength between the bridge girders and the concrete piers by the connection concrete, and can effectively suppress expansion/contraction, bending, and torsion of the bridge girders.

Further, the connecting plate is connected with the connecting rod embedded in the pier while connecting the bridge girder portions supported by the concrete pier in the bridge width direction, whereby the strength of the connection concrete itself against the expansion/contraction, torsion, and the like of the bridge girders can be easily and reliably increased in an interactive manner, and the structure becomes effective as prevention against bridge collapse in serious earthquakes.

DESCRIPTION OF EMBODIMENTS

Hereinafter, a preferable embodiment for implementing the present invention will be described on the basis of FIGS. 1 to 18.

<Overall Structure of Slab>

Figure 1:
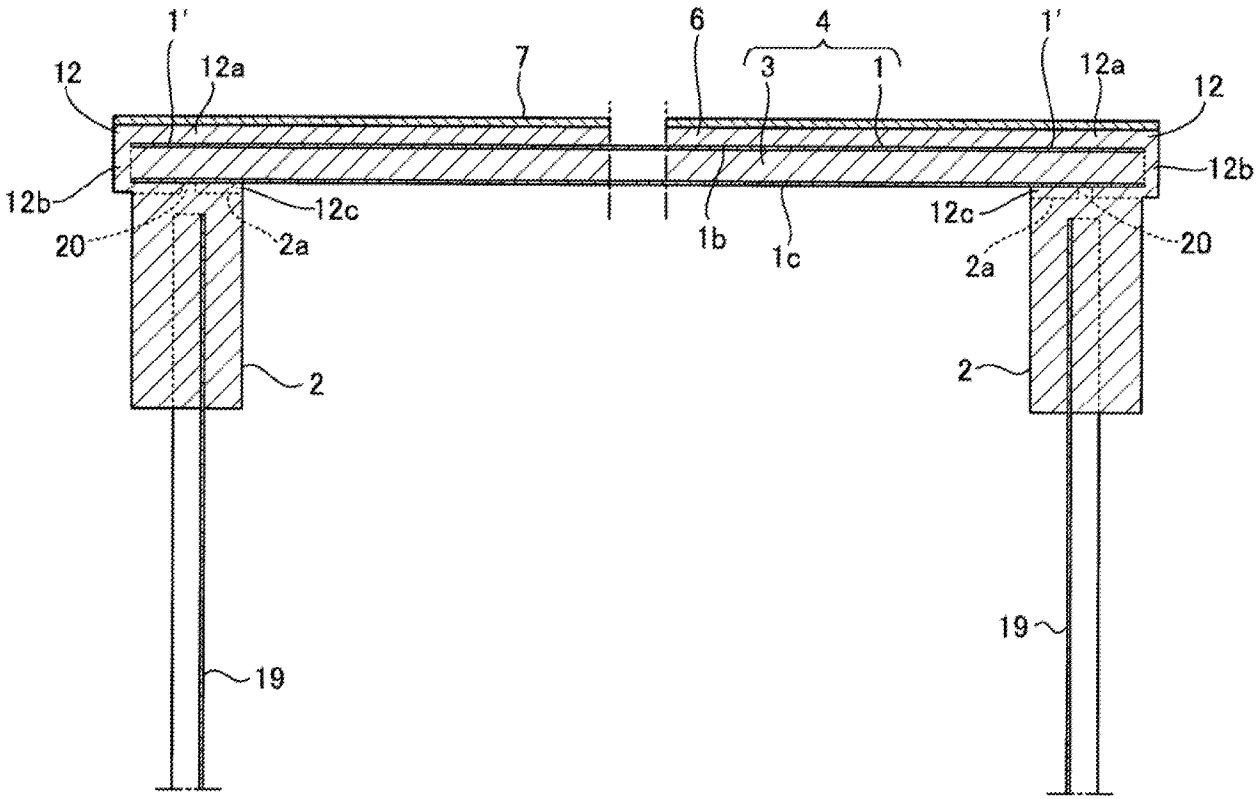
FIG. 1 is a diagram of a slab bridge according to the present invention in section view on a plane of a bridge girder in a bridge length direction.
Figure 3:
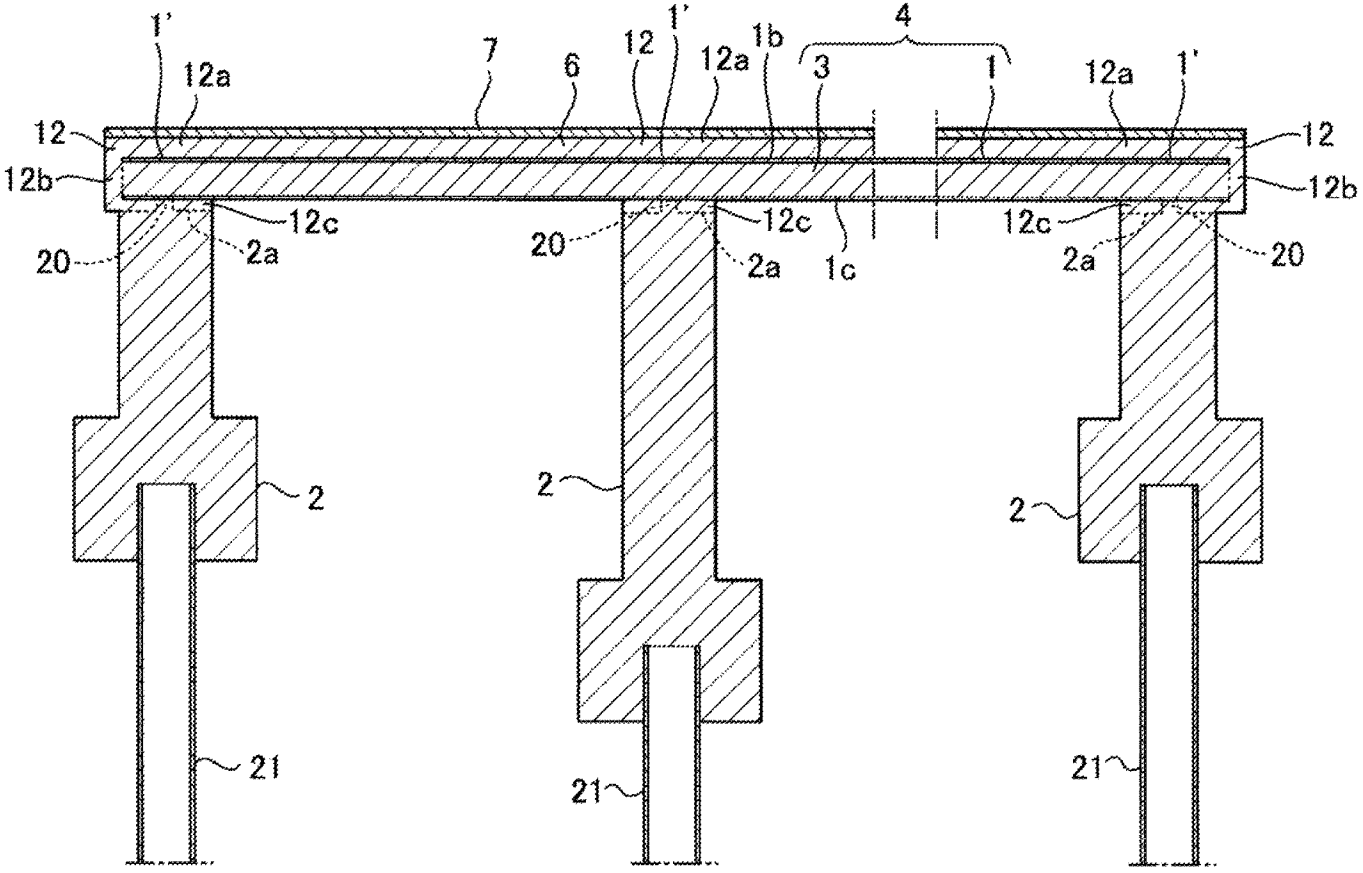
FIG. 3 is a diagram of another example of the slab bridge according to the present invention in section view on a plane of a bridge girder in bridge length direction.
Figure 5:
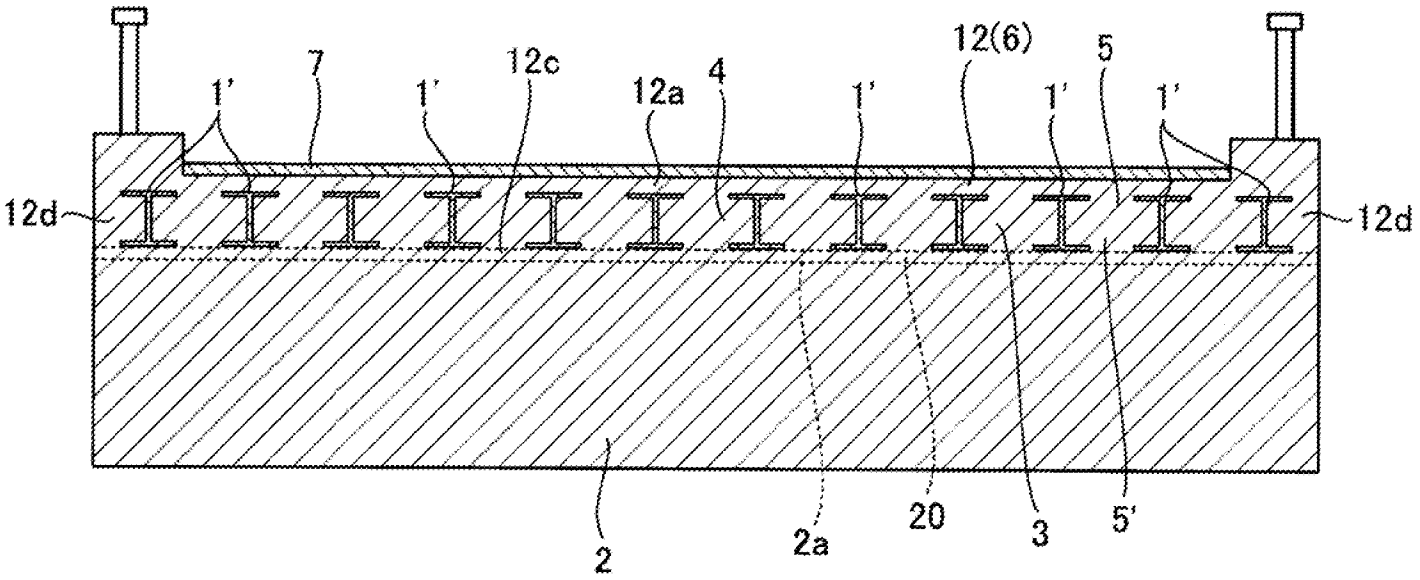
FIG. 5 is a sectional view of the slab bridge of the above-described examples in a bridge width direction.

As illustrated in FIGS. 1, 3, 5, and the like, a plurality of bridge girders 1 are arranged in line in a bridge width direction while being supported on piers 2, and slab concrete 3 are poured and formed between side surfaces of the bridge girders 1 throughout a longitudinal direction of the bridge girders 1, whereby a slab 4 made of a composite structure of the bridge girders 1 and the slab concrete 3.

FIG. 1 illustrates a single span slab bridge in which the piers 2 are respectively installed in banks of a river, and both ends of the bridge girder 1 are supported on the piers 2, and FIG. 3 illustrates a multi span slab bridge provided with a pier 2 that support a middle of an extending length of the bridge girder 1. The present invention is conducted for the single span slab bridge and the multi span slab bridge.

Figure 6:
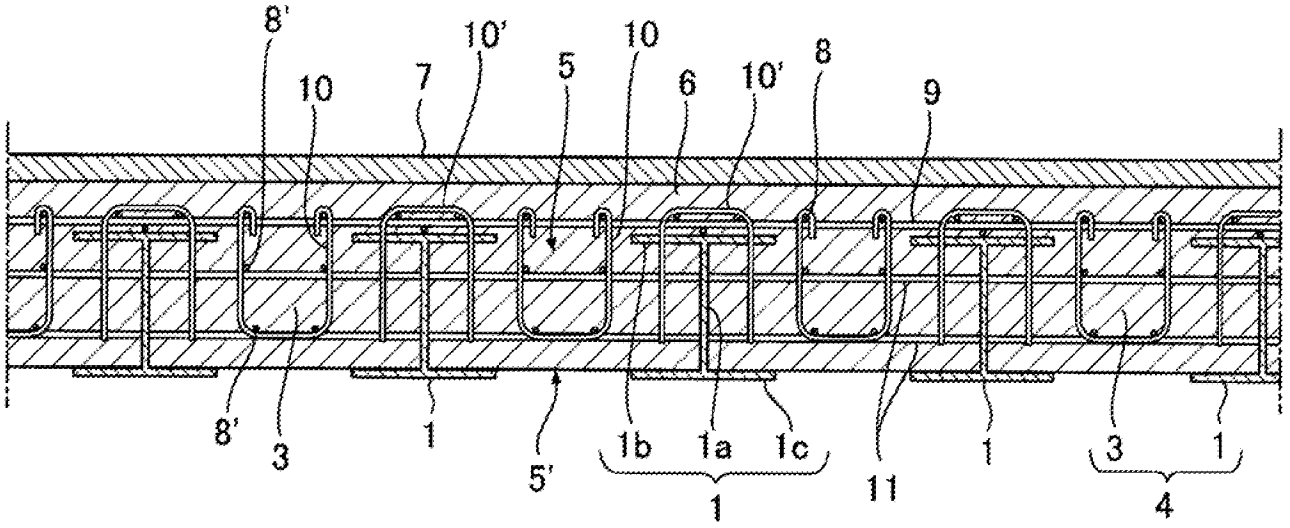
FIG. 6 is an essential part enlarged view of the slab bridge of the above-described examples in section view in a portion provided with a hanged reinforcing bar of a slab concrete portion.
Figure 8:
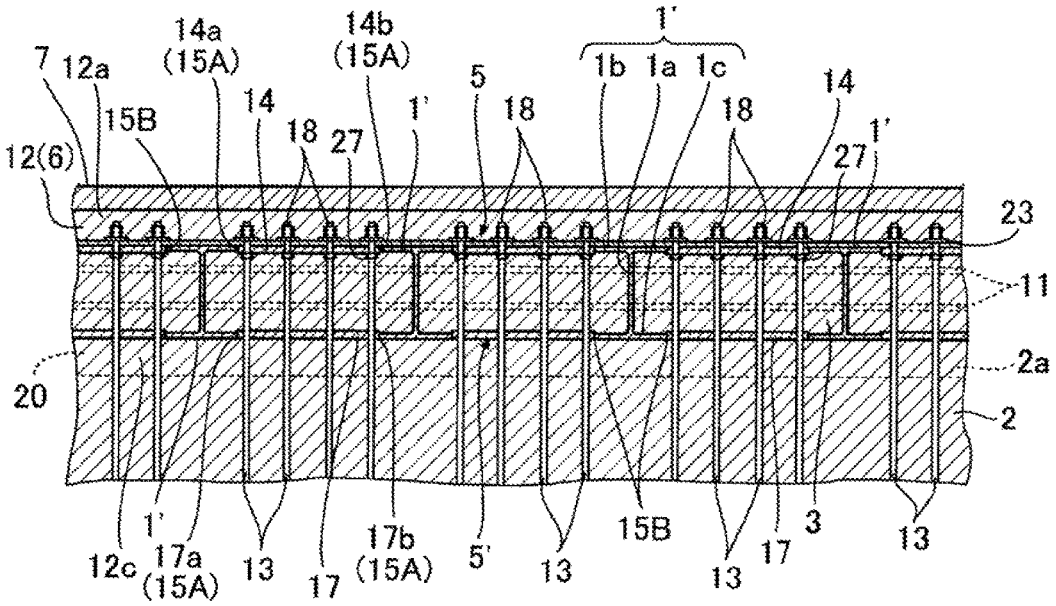
FIG. 8 is an essential part enlarged sectional view of the above-describe connecting example in section view in a portion provided with connecting rods.

The bridge girder 1 is a steel girder or a concrete girder. As a preferable example, as illustrated in FIGS. 5, 6, 8, and the like, an H-beam bridge girder 1 including an upper flange 1*b* on an upper end of a web plate 1*a* and a lower flange 1*c* on a lower end of the web plate 1*a* is used, the concrete is poured and the slab concrete 3 is formed in a space defined by the upper and lower flanges 1*b* and 1*c* and the web plate 1*a* between the adjacent bridge girders 1 in the bridge width direction, and the slab 4 made of the composite structure of the bridge girder 1 and the slab concrete 3 is formed.

An upper opening 5 extending in the bridge length direction is included between upper end portions of the adjacent bridge girders 1, that is, between the upper flanges 1*b*. Similarly, a lower opening 5' extending in the bridge length direction between lower end portions of the adjacent bridge girders 1, that is, between the lower flanges 1*c* is closed by a closing member, and the concrete is poured in the space through the upper opening 5, that is, the space is filled, whereby the slab concrete 3 is formed.

The closing member to close the lower opening 5' is removed or is left as it is after the slab concrete 3 is formed. However, as illustrated in FIGS. 8, 9(B), 11(B), and 12(B), in a portion of a bridge girder portion 1', the portion facing a bridge seat 2*a* of the pier 2, the concrete is poured in the space between the bridge girders without closing the lower opening 5' for pouring connection concrete 12 described below and the slab concrete 3 is formed, and a part of the concrete is caused to flow out toward the bridge seat 2*a* through the lower opening 5' to be concrete-joined with the bridge seat 2*a* at the same time.

At the same time, roadbed concrete 6 integrally joined with all the upper flanges 1*b* (all the bridge girders 1) through the upper openings 5 is poured and formed, and road pavement 7 is applied on an upper surface of the roadbed concrete 6.

As illustrated in FIG. 6, a vertically installed reinforcing bar 8 extending in the bridge length direction and a horizontally installed reinforcing bar 9 extending in the bridge width direction are constructed in the roadbed concrete 6, that is, the vertically installed reinforcing bar 8 and the horizontally installed reinforcing bar 9 are constructed and placed on the upper flange 1*b* as the upper end portion of the bridge girder 1, and a hanged reinforcing bar 10 constructed with the vertically installed reinforcing bar 8 or the horizontally installed reinforcing bar 9 is vertically installed and embedded in the slab concrete 3 through the upper opening 5.

As an example of the hanged reinforcing bar 10, as illustrated in FIG. 6, a reinforcing bar is bent into a U shape. Further, both arms are constructed with the horizontally installed reinforcing bar 9, and free ends of the both arms are folded and constructed with the vertically installed reinforcing bar 8. Further, a hanged reinforcing bar 10' obtained by bending a reinforcing bar into an inverted U shape is formed, connecting portions of the hanged reinforcing bar 10' are constructed with the vertically installed reinforcing bar 8 or the horizontally installed reinforcing bar 9, and both arms are inserted into at least the upper flange 1*b* of the bridge girder 1 and embedded in the slab concrete 3.

A vertically installed reinforcing bar 8' is constructed with the hanged reinforcing bar 10 or 10' and embedded in the slab concrete 3, and an inserting rod 11 to be inserted into all the web plates 1*a* in the bridge width direction is embedded in the slab concrete 3.

Describing again the overall structure of the slab according to the present invention, a concrete pouring space is formed between the bridge girders 1, using various concrete bridge girders such as an H-beam bridge girder, a T-beam bridge girder, and an I-beam bridge girder made of steel material, as the bridge girder 1, the upper opening 5 is formed between the upper end portions of the adjacent bridge girders 1, the concrete is poured, that is, filled in the space through the upper opening 5, whereby the slab concrete 3 is formed. At the same time, the roadbed concrete 6 integrally joined with the upper surfaces of all the bridge girders 1 through the upper openings 5 is poured and formed, and the road pavement 7 is applied to the upper surface of the roadbed concrete 6.

Then, the vertically installed reinforcing bars 8 and the horizontally installed reinforcing bars 9 placed on the upper surfaces of all the bridge girders 1 are embedded in the roadbed concrete 6, and the hanged reinforcing bars 10 and 10' are vertically installed and embedded in the slab concrete 3, and the inserting rods 11 inserted in web portions of all the bridge girders 1 in the bridge width direction are embedded in the slab concrete 3.

It is obvious that large numbers of the horizontally installed reinforcing bars 9, the hanged reinforcing bars 10 and 10', and the inserting rods 11 are arranged in the bridge length direction at intervals, and large numbers of the vertically installed reinforcing bars 8 and 8' are arranged in the bridge width direction at intervals.

<Structure on Bridge Seat of Concrete Pier: Rigid Connection Structure by Concrete Joining>

In the present invention, a structure in which the slab concrete 3 that constitutes the above-described slab 4 is concrete-joined with the concrete piers 2 through the connection concrete 12, and the bridge girders 1 that constitute the slab 4 and the concrete piers 2 are rigidly connected is formed.

Figure 2:
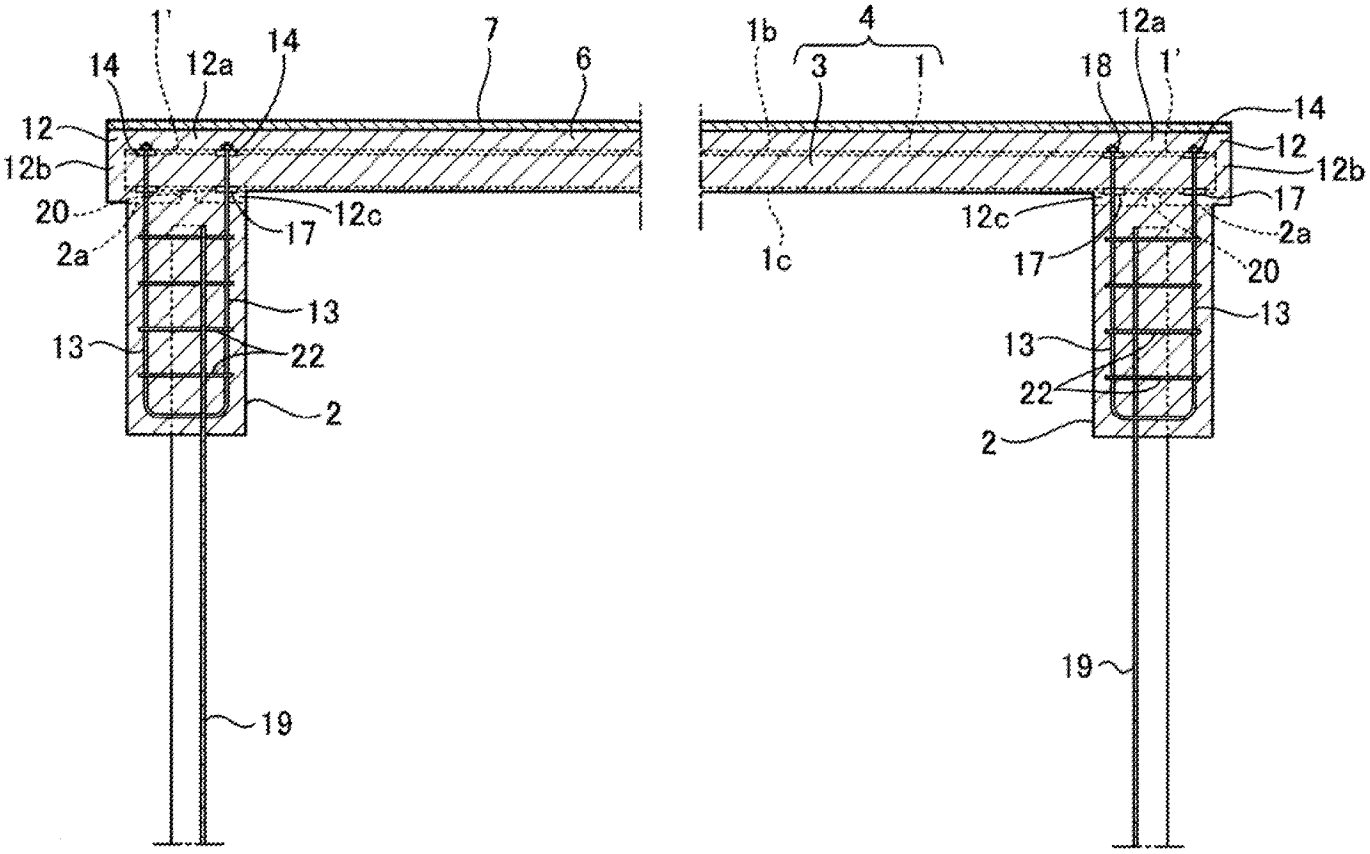
FIG. 2 is a diagram of the slab bridge in section view on a plane of slab concrete in the bridge length direction.
Figure 4:
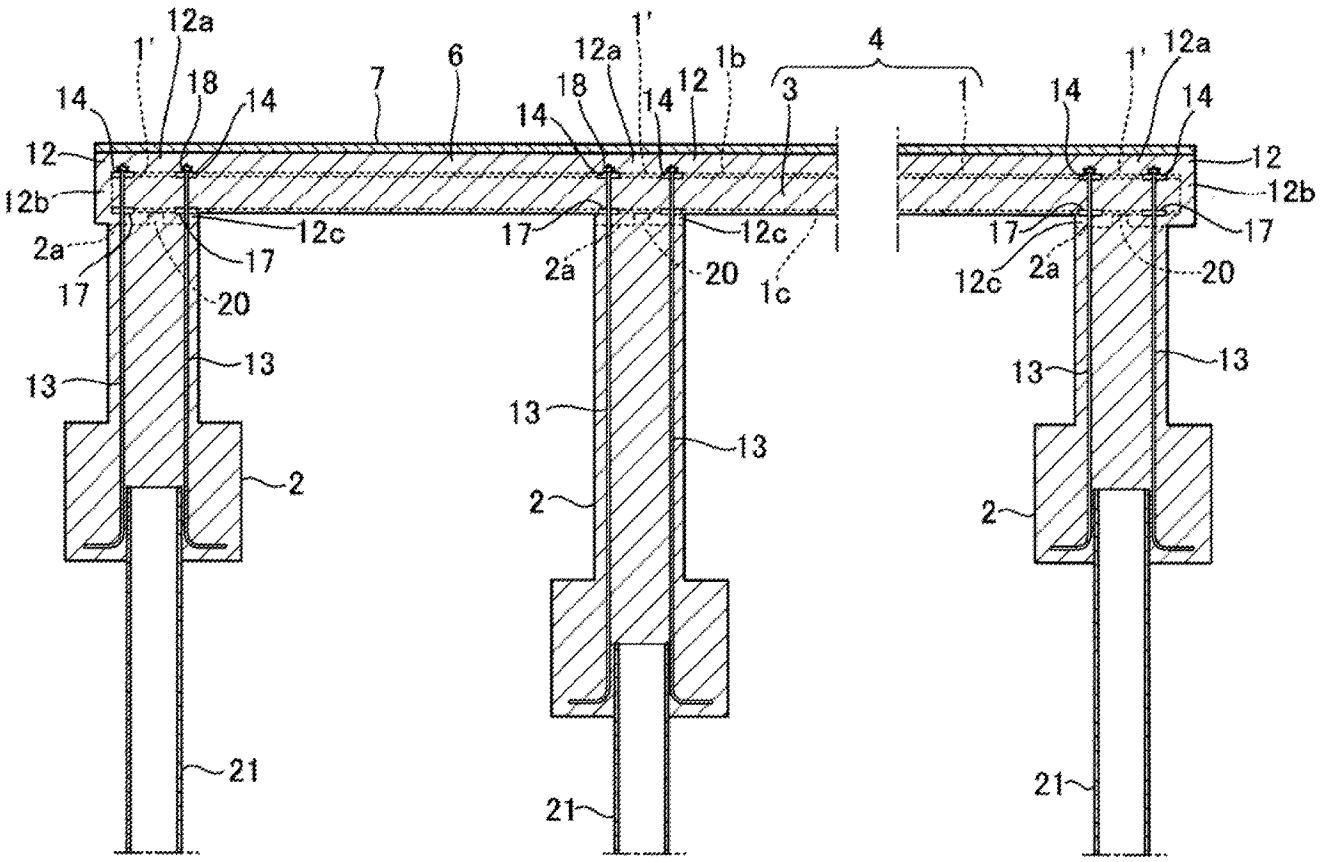
FIG. 4 is a diagram of another example of the slab bridge in section view on a plane of slab concrete in the bridge length direction.

In more details, a rigid connection structure of a portal rigid frame structure is configured, in which the connection concrete 12, in which the bridge girder portions 1' supported by the bridge seats 2*a* are embedded, is added onto the bridge seats 2*a* of the concrete piers 2 that support lower end surfaces of the bridge girders 1, the slab concrete 3 and the concrete piers 2 are concrete-joined through the connection concrete 12, as illustrated in FIGS. 2 and 4, and the bridge girders 1 are joined with the piers 2 through the slab concrete 3 and the connection concrete 12.

That is, after the concrete piers 2 are built, the lower end surfaces of the bridge girders 1 are supported by the bridge seats 2*a*, or the lower flanges 1*c* are supported by the bridge seats 2*a* in the case of the H-beam bridge girders 1, and the connection concrete 12 is poured and formed on the bridge seats 2*a*.

As illustrated in FIGS. 2, 4, and 5, the connection concrete 12 makes the concrete piers 2 substantially bulky, and upper end surfaces of the bridge girder portions 1', or the upper surfaces of the upper flanges 1*b* in the case of the H-beam bridge girders 1, are covered with a top portion 12*a* of the connection concrete 12, that is, the upper end portions (upper flanges 1*b*) of the bridge girder portions 1' are embedded in the top portion 12*a* of the connection concrete 12, and the connection concrete 12 and the slab concrete 3 are concrete-joined through the upper openings 5 formed between the adjacent upper end portions. The top portion 12*a* of the connection concrete 12 constitutes a part of the roadbed concrete 6.

Further, as illustrated in FIGS. 1 and 3, end surfaces of the bridge girder portions 1' in ends in the bridge length are covered with rear end portions 12*b* of the connection concrete 12, that is, end surfaces of the bridge girders are embedded in the rear end portions 12*b*, and the connection concrete 12 is concrete-joined with the slab concrete 3 through end-portion openings between the end surfaces of the adjacent bridge girders. The slab concrete 3 between the adjacent bridge girder portions 1' constitutes a part of the connection concrete 12.

Further, as illustrated in FIG. 5, outside surfaces of the bridge girder portions 1' supported by right and left ends in the bridge width direction are covered with right and left side portions 12*d* of the connection concrete 12 in the bridge width direction. That is, the outside surfaces are embedded in the right and left side portions 12*d*.

As described above, as illustrated in FIGS. 1 to 4, a structure in which the connection concrete 12 is a bridge-connected with the slab 4 in the composite structure is obtained.

As illustrated in FIG. 3, the concrete pier 2 is stood on a buried pile 21, and as described above, the portal rigid frame structure is built, in which the piers 2 and the slab concrete 3 are concrete-joined (rigidly connected) with the connection concrete 12, and the bridge girders 1 (bridge girder portions 1') are rigidly connected with the piers 2 through the slab concrete 3 and the connection concrete 12.

Alternatively, as illustrated in FIG. 1, the portal rigid frame structure is built, in which sheet piles 19 are knocked into the ground while joined with one another, facing the banks, to build earth-retaining walls, which are continuously formed in the bridge width direction, the concrete piers 2 are supported by upper ends of the sheet piles 19 projecting above water or ground, the piers 2 and the slab concrete 3 are concrete-joined (rigidly connected) with the connection concrete 12, and the bridge girders 1 (bridge girder portions 1') are rigidly connected with the piers 2 through the slab concrete 3 and the connection concrete 12.

As the sheet pile 19, a steel sheet pile made of a steel plate and having joints in both side edges is used, as illustrated in FIG. 1, and a structure in which a large number of the steel sheet piles 19 are knocked into the ground while connected with the joints to form sheet pile bases and the earth-retaining walls, and the concrete piers 2 are supported by upper ends of the earth-retaining walls is obtained. Alternatively, the structure in which a large number of the sheet piles 19 made of steel pipe poles or concrete poles is knocked into the ground to form the sheet pile bases and the earth-retaining walls, and the concrete piers 2 are supported by the upper ends of the earth-retaining walls is obtained.

The bridge girders 1 (bridge girder portions 1') are directly supported by the bridge seats 1*a* of the concrete piers 2, or sleepers 20 are provided on the bridge seats 2*a* and the bridge girders 1 are supported by the sleepers 20, that is, the bridge girders 1 are indirectly supported by the bridge seats 2*a* through the sleepers 20, and the sleepers 20 are embedded in the connection concrete 12.

In more details, the concrete poured through the upper opening 5 is filled in the space between the bridge girders to form the slab concrete 3. At the same time, the concrete flows out onto the bridge seats 2*a* through the lower opening 5' to concrete-join the slab concrete 3 and the piers 2. Therefore, the connection concrete 12 that coats the bridge girder portions 1' on the piers 2 constitutes a part of the slab concrete 3.

Spaces are formed between the slab 4 and the bridge seats 2*a* due to intervention of the sleepers 20, the connection concrete 12 is filled in the spaces through the lower opening 5' and is concrete-joined with the bridge seats 2*a*, and a bottom portion 12*c* of the connection concrete 12 filled in the spaces coats lower surfaces of the bridge girder portions 1', or lower surfaces of the lower flanges 1*c* in the case of the H-beam bridge girder. That is, the sleepers 20 are embedded in the bottom portion 12*c* at the same time with the lower flanges 1*c* being embedded in the bottom portion 12*c* of the connection concrete 12.

In a case where no sleepers 20 intervene, a part of the slab concrete 3 flows out to the bridge seats 2*a* through the lower opening 5', and is concrete-joined with the bridge seats 2*a*.

As the sleeper 20, an H-beam sleeper or a concrete sleeper is used. As a preferable example, a concrete sleeper 20 integrally placed with the concrete pier 2 is provided from an approximately central portion of the bridge seat 2*a* in the bridge length direction. Alternatively, the sleeper 20 is independently provided for each bridge girder, or provided to continuously extend in the bridge width direction.

As described above, the lower flanges 1*c* as the lower end portions of the bridge girder portions 1' in the case where the bridge girder 1 is the H-beam bridge girder 1 are directly supported by the bridge seats 2*a* of the concrete piers 2, or the lower flanges 1*c* are indirectly supported by the bridge seats 2*a* through the sleepers 20. The upper flanges 1*b* as the upper end portions of the bridge girder portions 1' are covered with the top portion 12*a* of the connection concrete 12. The ends of the bridge girder portions 1' in the bridge length are covered with the rear end portions 12*b* of the connection concrete 12. The outside surfaces of the bridge girder portions 1' supported by the right and left ends in the bridge width direction are covered with the right and left side portions 12*d* of the connection concrete 12. The bridge girder portions 1' are embedded in the connection concrete 12. Therefore, the slab concrete 3 between the bridge girder portions 1' and the bridge seams 2*a* of the concrete piers 2 that support the bridge girder portions 1' are concrete-joined through the connection concrete 12.

In the case of providing the sleepers 20, the connection concrete 12 is filled in the spaces between the slab 4 and the bridge seats 2*a* or the space between the lower flanges 1*c* of the bridge girder portions 1' and the bridge seats 2*a*, the spaces being formed by the sleepers 20, through the lower opening 5', to be concrete-joined with the bridge seats 2*a*. The lower surfaces of the lower flanges 1*c* as the lower end surfaces of the bridge girder portions 1' are covered with the bottom portion 12*c* of the connection concrete 12 filled in the spaces, and the sleepers 20 are embedded in the bottom portion 12*c*.

Similarly, in cases of using various forms of concrete bridge girders as the bridge girder 1, such as the T-beam bridge girder and the I-beam bridge girder made of steel material, the lower end surfaces of the bridge girder portions 1' of the bridge girders 1 are directly supported by the bridge seats 2*a* of the concrete piers 2 or indirectly supported by the bridge seats 2*a* through the sleepers 20, the bridge girder portions 1' are embedded in the connection concrete 12, and the slab concrete 3 between the bridge girder portions 1' and the bridge 2*a* of the concrete piers 2 that support the bridge girder portions 1' are concrete-joined through the connection concrete 12.

<Structure on Bridge Seat of Concrete Pier: Reinforced Structure by Connecting Rod and Connecting Plate>

In the present invention, as a concrete joining structure by the connection concrete 12, that is, means to reinforce a rigid connection structure, as illustrated in FIG. 8 and the like, the bridge girder portion 1' supported by the bridge seat 2*a* of the concrete pier 2 and embedded in the connection concrete 12, and the concrete pier 2 are connected with connecting rods 13 and a connecting plate 14. The connecting rod 13 is made of the pier 2 and a connecting wire or a connecting pipe to be embedded in the connection concrete 12. The connecting plate 14 is made of a steel plate to be embedded in the connection concrete 12 in a state where the connecting plate 14 connects the upper end portions of the adjacent bridge girder portions 1'. The connecting rods 13 and the connecting plate 14 form the rigid connection structure in cooperation with the connection concrete 12.

The connecting rod 13 extends and is embedded in the vertical direction throughout approximately the entire height in the concrete pier 2, and an upper end projects upward from the bridge seat 2*a*. The projection portion penetrates a portion corresponding to the slab concrete 3 between the bridge girder portions 1' and the connecting plate 14 described in details below, and is connected with the pier 2.

FIGS. 2 and 4 illustrate specific examples of the connecting rod 13. As exemplarily illustrated in FIG. 2, two connecting rods 13 formed by bending a reinforcing bar into U shape, and connecting the two bent reinforcing bars, are prepared. The connecting rods 13 are embedded in the concrete pier 2 in the vertical direction, and upper ends are connected with the connecting plate 14 while being embedded in the connection concrete 12.

Alternatively, as exemplarily illustrated in FIG. 4, a plurality of separated connecting rods 13 is used. The connecting rods 13 are embedded in the concrete pier 2 in the vertical direction, and upper ends are connected with the connecting plate 14 while being embedded in the connection concrete 12.

Further, as illustrated in FIG. 2, in a case where the concrete pier 2 is supported by the upper end of the sheet pile 19, sheet pile connecting reinforcing bars 22 that allow the upper end of the sheet pile 19 to penetrate are constructed between the two connecting rods 13 that are bent into the U shape and connected, and firmly connect the connecting rods 13 and the upper end of the sheet pile 19 through the concrete. That is, the concrete pier 2 is firmly connected with the upper end of the sheet pile 19 with the connecting rods 13 and the sheet pile connecting reinforcing bars 22.

It is obvious that a plurality of the connecting rods 13 and the sheet pile connecting reinforcing bars 22 is arranged in the bridge width direction. Alternatively, as the connecting rod 13, the bridge seat 2*a* of the concrete pier 2 is drilled in the vertical direction, and a connecting rod 13 embedded in the hole formed by the drilling through filling material, and an upper end of which protrudes upward from the bridge seat 2*a*, may be arbitrarily used according to implementation.

The connecting plate 14 connects the upper end portions of the adjacent bridge girder portions 1', the projection portions of the connecting rods 13 are inserted into the connecting plate 14 that connects the upper end portions of the bridge girder portion 1', stoppers such as nuts 18 are provided to upper-end projection portions of the connecting rods 13 inserted into the connecting plate 14, and the stoppers are fastened to an upper surface of the connecting plate 14 to connect the bridge girders 1 (the bridge girder portions 1') to the concrete pier 2.

For example, in the case where the bridge girder 1 is the H-beam bridge girder, the upper flanges 1*b* as the upper end portions of the adjacent bridge girder portions 1' are connected with the connecting plate 14, the connecting rods 13 are inserted into through-holes provided in the connecting plate 14, the nuts 18 are screwed onto male screws of the connecting rods 13 projecting from the upper surface of the connecting plate 14, and the nuts 18 are fastened to the upper surface of the connecting plate 14, thereby to connect the bridge girder portion 1' with the pier 2.

Similarly, in the case of using the T-beam bridge girder or the I-beam bridge girder made of steel material as the bridge girder 1, the upper flanges of the bridge girders are connected with the connecting plate 14, the upper-end projection portions of the connecting rods 13 are inserted into the connecting plate 14, and the stoppers such as the nuts 18 are fastened to the upper surface of the connecting plate 14. Further, in the cases of using various concrete bridge girders as the bridge girder 1, the upper end portions of the concrete girder bodies are connected with the connecting plate 14, the upper-end projection portions of the connecting rods 13 are inserted into the connecting plate 14, and the stoppers such as the nuts 18 are fastened to the upper surface of the connecting plate 14.

Figure 7:
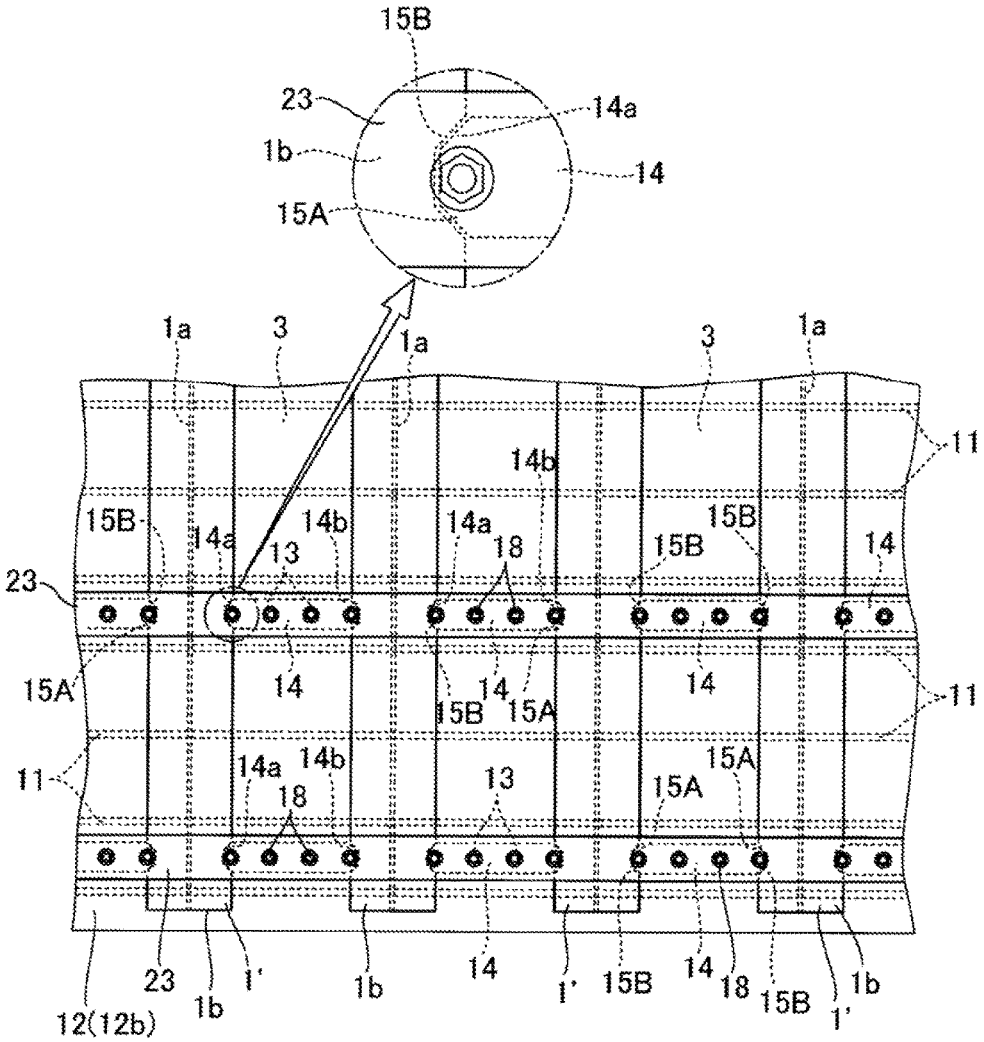
FIG. 7 is an essential part enlarged plan view schematically illustrating an example of connecting upper end portions of bridge girder portions of all the bridge girders with a connecting plate, omitting roadbed concrete and road pavement.
Figure 10:
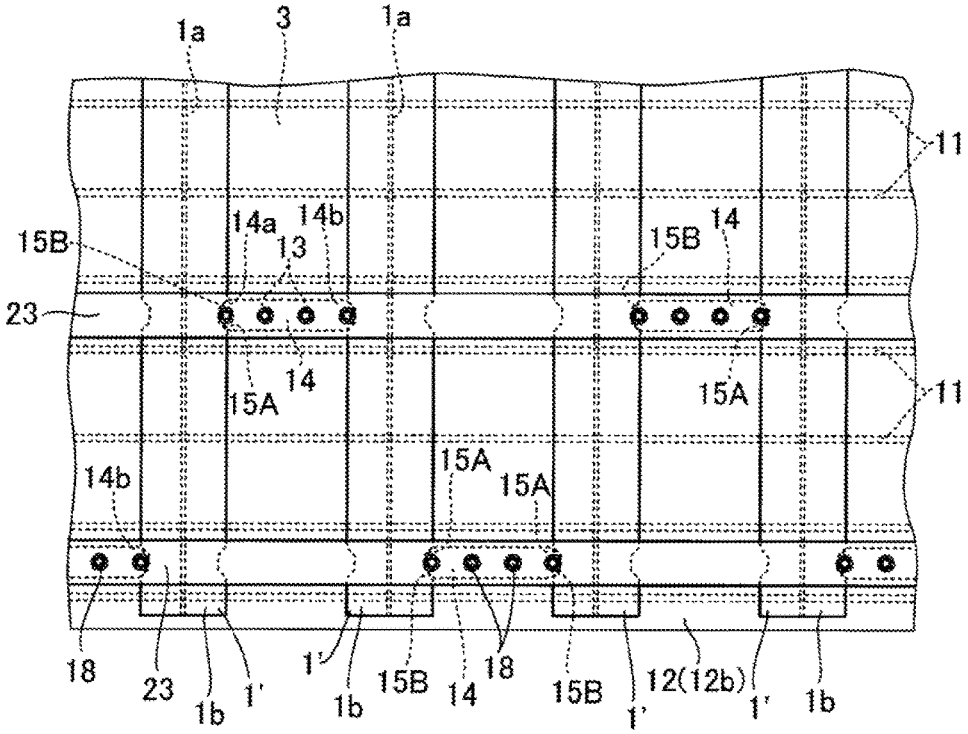
FIG. 10 is an essential part enlarged plan view schematically illustrating another example of connecting the upper end portions of the bridge girder portions of all the bridge girders with the connecting plate, omitting roadbed concrete and road pavement.

FIGS. 7, 10, and 11 illustrate examples of connecting the upper end portions of all the bridge girder portions 1' arranged in line in the bridge width direction with the connecting plate 14, that is, examples of connecting all the upper end portions of the bridge girder portions 1' of the bridge girders 1 or all the upper flanges 1*b* in the case of the H-beam bridge girders with a plurality of the connecting plates 14. Especially, FIGS. 7 and 11 illustrate examples of linearly arranging a plurality of the connecting plates 14 in two places with an interval in the bridge length direction, and connecting all the bridge girder portions 1'. FIG. 10 illustrates an example of alternately arranging a plurality of the connecting plates 14 in two places with an interval in the bridge length direction, and connecting all the bridge girder portions 1'.

As illustrated in FIGS. 7 to 10, fitting convex portions 15A are respectively formed in one end portion 14*a* and the other end portion 14*b* of the connecting plate 14. On the other hand, fitting concave portions 15B to be fit with the fitting convex portions 15A are respectively formed in the upper flanges 1*b* of the adjacent bridge girder portions 1'.

Then, the fitting convex portion 15A as the one end portion 14*a* of the connecting plate 14 is fit into the fitting concave portion 15B formed in the upper flange 1*b* of one adjacent bridge girder portion 1', and the fitting convex portion 15A as the other end portion 14*b* of the connecting plate 14 is fit into the fitting concave portion 15B formed in the upper flange 1*b* of the other adjacent bridge girder portion 1', thereby to connect the upper end portions, that is, the upper flanges 1*b* of the adjacent bridge girder portions 1'.

Figure 11A:
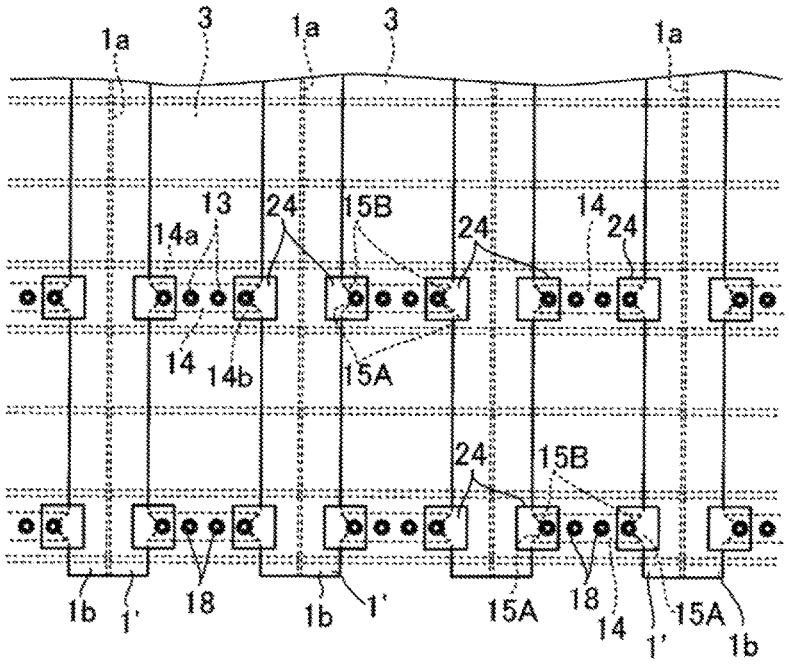
FIG. 11(A) is an essential part enlarged explanatory view schematically illustrating another example of connecting the upper end portions of the bridge girder portions of all the bridge girders with the connecting plate, omitting roadbed concrete and road pavement.
Figure 11B:
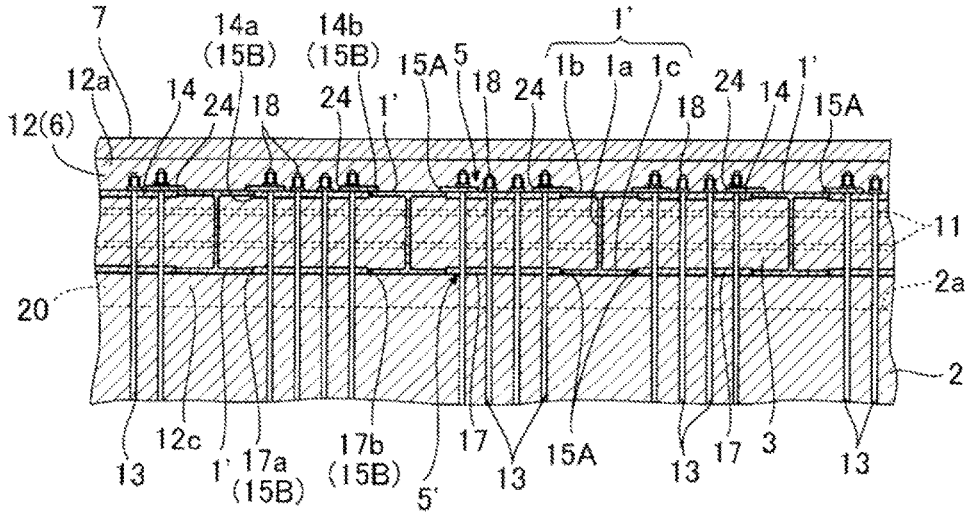
FIG. 11(B) is an essential part enlarged sectional view of the connecting example in section view in a portion provided with the connecting rods.

Further, as illustrated in FIGS. 11(A) and 11(B), the connecting plate 14 can be configured to have the fitting concave portions 15B respectively formed in the one end portion 14*a* and in the other end portion 14*b*, in a way opposite to the connecting example of FIG. 7. In this case, the fitting convex portions 15A to be fit into the fitting concave portions 15B can be formed in both the upper flanges 1*b* of the bridge girder portions 1' to be connected.

Then, the fitting concave portion 15B as the one end portion 14*a* of the connecting plate 14 is fit with the fitting convex portion 15B formed in the upper flange 1*b* of one adjacent bridge girder portion 1', and the fitting concave portion 15B as the other end portion 14*b* of the connecting plate 14 is fit with the fitting convex portion 15A formed in the upper flange 1*b* of the other adjacent bridge girder portions 1', thereby to connect the upper flanges 1*b* of the adjacent bridge girder portions 1'.

As described above, the upper end portions of the adjacent bridge girder portions 1' can be easily connected with the connecting plate 14, and even if the adjacent bridge girders 1 are slightly shifted in the bridge length direction, the shift can be effectively absorbed.

As illustrated in FIG. 8, preferably, a support member 27 made of a nut and the like that supports the connecting plate 14 from below is arranged under the connecting plate 14.

Further, in the examples illustrated in FIGS. 7 and 10, a narrow seat plate 23 extending in the bridge width direction is installed on the upper surfaces of the bridge girder portions 1', that is, the upper surfaces of the upper flanges 1*b* in the case of the H-beam bridge girders, and the upper surfaces of each of the connecting plates 14. The upper-end projection portions of the connecting rods 13 are inserted into the through-holes provided in the narrow seat plate 23, and the nuts 18 are screwed onto the upper-end projection portions (male screw portions) on an upper surface of the narrow seat plate 23, and are sit on the narrow seat plate 23.

Further, FIGS. 11(A) and 11(B) illustrate an example of using a square seat plate 24 that bears only an upper surface of a fit portion of the upper end portion of the bridge girder portion 1' and the connecting plate 14, unlike the narrow seat plate 23.

That is, the square seat plate 24 is installed on a fit portion of the fitting convex portion 15A of the upper flange 1*b* of one adjacent bridge girder portion 1' and the fitting concave portion 15B as the one end portion 14*a* of the connecting plate 14, and another square seat plate 24 is installed on a fit portion of the fitting convex portion 15A of the upper flange 1*b* of the other adjacent bridge girder portion 1' and the fitting concave portion 15B as the other end portion 14*b* of the connecting plate 14. The upper-end projection portions of the connecting rods 13 are respectively inserted into the through-holes provided in the square seat plates 24, and the nuts 18 are respectively screwed onto the upper-end projection portions (male screw portions) on the upper surface of the square seat plates 24, and are sit on the respective square seat plates 24.

Further, in the present invention, the lower end portions (lower flanges 1*c*) of the bridge girder portions 1' connected with the connecting plate 14 are connected with an auxiliary connecting plate 17, and the connecting rods 13 are inserted into the auxiliary connecting plate 17, whereby the bridge girder portions 1' to be connected can be reliably and firmly connected in the upper and lower end portions.

As the auxiliary connecting plate 17, preferably a steel plate having a similar configuration to the above-described connecting plate 14 is used, and the lower flanges 1*c* as the lower end portions of the adjacent bridge girder portions 1' are connected with the auxiliary connecting plate 17, as needed.

That is, as illustrated in FIG. 8, the fitting convex portions 15A are respectively formed in one end portion 17*a* and the other end portion 17*b* of the auxiliary connecting plate 17. On the other hand, the fitting concave portions 15B to be fit with the fitting convex portions 15A are respectively formed in the lower flanges 1*c* of the bridge girder portions 1' to be connected in the case of the H-beam bridge girders. The fitting convex portion 15A as the one end portion 17*a* of the auxiliary connecting plate 17 is fit into the fitting concave portion 15B formed in the lower flange 1*c* of one adjacent bridge girder portion 1', and the fitting convex portion 15A as the other end portion 17*b* of the auxiliary connecting plate 17 is fit into the fitting concave portion 15B formed in the lower flange 1*c* of the other adjacent bridge girder portion 1', thereby to connect the lower end portions, that is, the lower flanges 1*c* of the adjacent bridge girder portions 1'.

Alternatively, as illustrated in FIGS. 11(A) and 11(B), the fitting concave portions 15B are respectively formed in the one end portion 17*a* and the other end portion 17*b* of the auxiliary connecting plate 17 and the fitting convex portions 15A are respectively formed in the lower flanges 1*c* of the bridge girder portions 1' to be connected, and the lower flanges 1*c* are connected with the auxiliary connecting plate 17.

The auxiliary connecting plate 17 is supported from below by the closing member that closes the lower opening 5' between the adjacent bridge girders 1 or by the sleeper 20, and is embedded in the connection concrete 12.

Figure 9A:
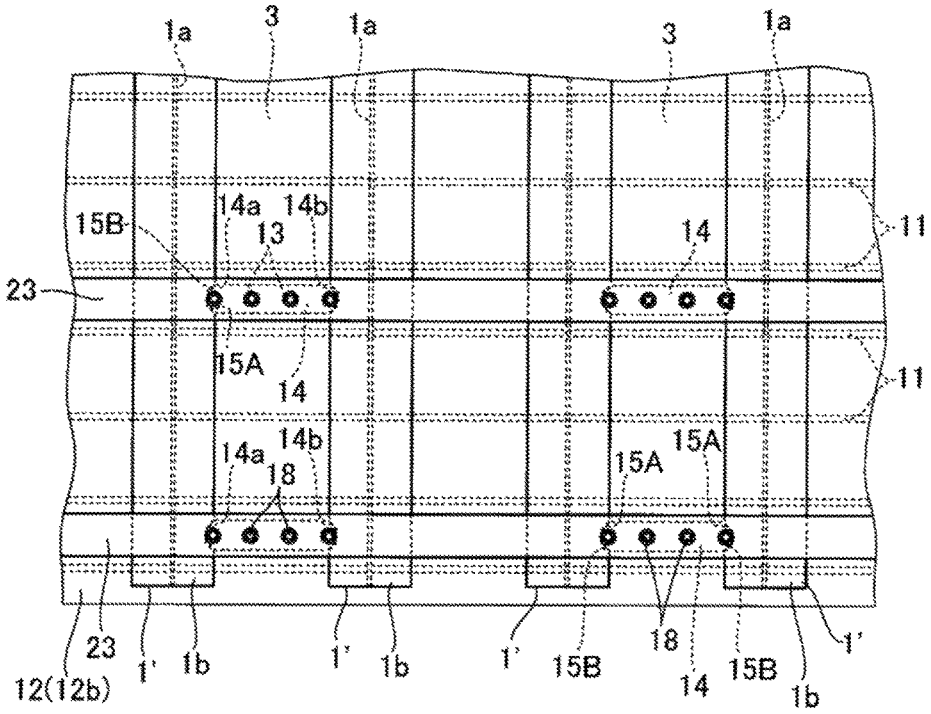
FIG. 9(A) is an essential part enlarged plan view schematically illustrating an example of connecting the upper end portions of the bridge girder portions of the bridge girders and at least one another bridge girder portion with the connecting plate, omitting the roadbed concrete and the road pavement.
Figure 9B:
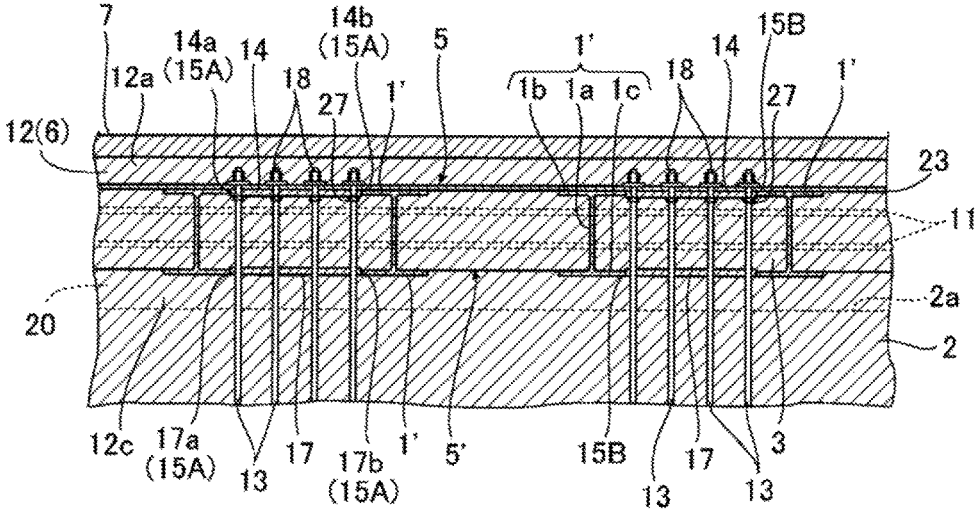
FIG. 9(B) is an essential part enlarged sectional view of the connecting example in section view in a portion provided with connecting rods.

FIGS. 9(A) and 9(B) illustrate an example of connecting the upper end portion of the bridge girder portion 1' of the bridge girder 1 with the upper end portion of at least one another bridge girder portion 1' through the connecting plate 14, unlike the above-described connecting examples. According to this connecting example, the upper end portions of the bridge girder portions 1' can be connected in the bridge width direction in a minimum necessary manner, and can be connected with the concrete piers 2 through the connecting rods 13.

That is, each of the upper end portions of the bridge girder portions 1' supported by the right and left ends in the bridge width direction is connected with the upper end portion of the bridge girder portion 1' adjacent at an inner side surface side of the bridge girder portion 1', through the connecting plate 14. Further, the upper end portions of the bridge girder portions 1' other than the bridge girder portions 1' supported by the right and left ends in the bridge width direction, that is, the upper end portions of the bridge girder portions 1' adjacent to other bridge girder portions 1' at both the right and left sides in the bridge width direction are connected with either one of the upper end portions of the bridge girder portions 1' adjacent at both sides, through the connecting plate 14.

In the case of the connecting example of FIGS. 9(A) and 9(B), a configuration to connect the upper end portions of the adjacent bridge girder portions 1' through the connecting plate 14, and a configuration to connect the lower end portions of the adjacent bridge girder portions 1' through the auxiliary connecting plate 17 are similar to the connecting examples of FIG. 7 and the like, and thus description is omitted here.

Next, other examples of the connecting plate 14 and the auxiliary connecting plate 17 will be described.

Figure 12A:
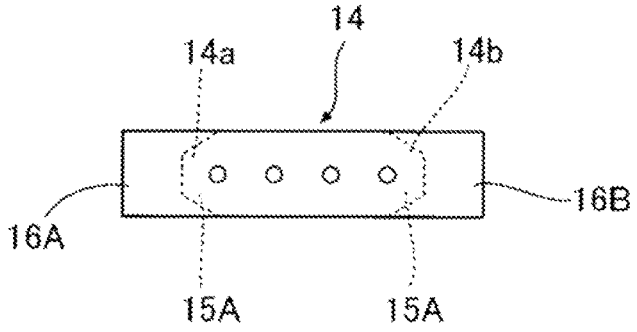
FIG. 12(A) is a plan view illustrating another example of the connecting plate.
Figure 12B:
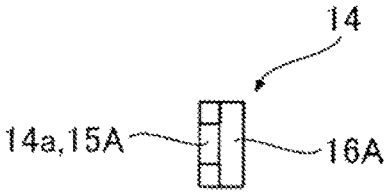
FIG. 12(B) is a side view of the connecting plate.
Figure 12C:
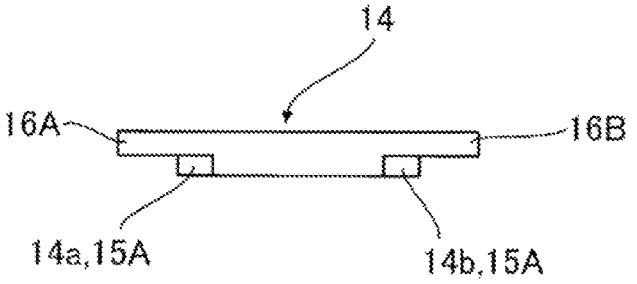
FIG. 12(C) is a front view of the connecting plate.
Figure 13A:
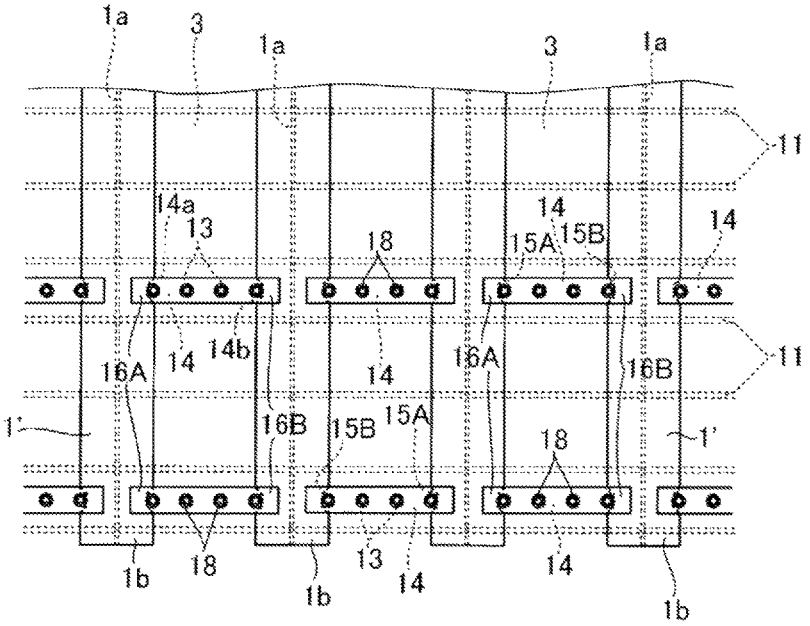
FIG. 13(A) is an essential part enlarged plan view schematically illustrating an example of connecting the upper end portions of adjacent bridge girder portions with the connecting plate with flanges, omitting roadbed concrete and road pavement.
Figure 13B:
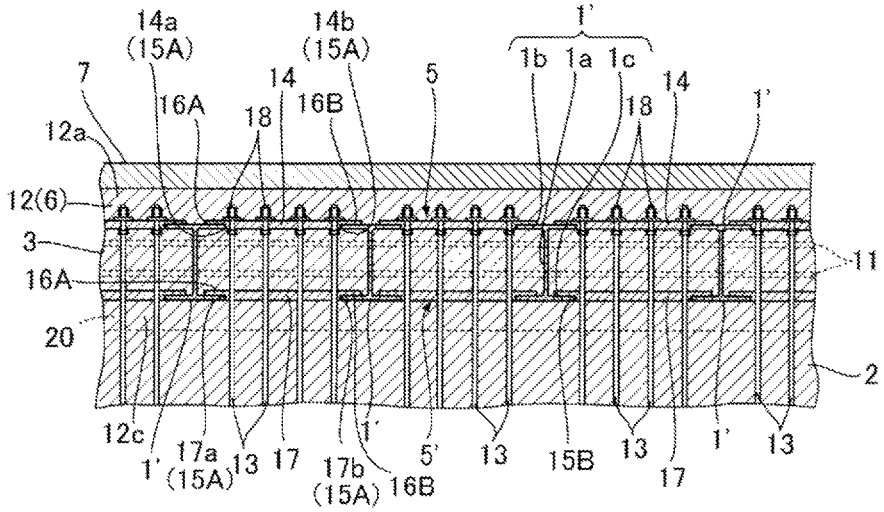
FIG. 13(B) is an essential part enlarged sectional view of the connecting example in section view in a portion provided with connecting rods.

FIGS. 12(A) to 12(C) illustrate the connecting plate 14 having a configuration in which a first flange 16A is installed in a protruding manner to one end portion 14*a* of the connecting plate 14 and a second flange 16B is installed in a protruding manner to the other end portion 14*b* of the connecting plate 14. As illustrated in FIGS. 13(A) and 13(B), the connecting plate 14 with the flanges has the first flange 16A engaged with the upper end portion of one adjacent bridge girder portion 1' and the second flange 16B engaged with the upper end portion of the other adjacent bridge girder portion 1', thereby to promptly and reliably connect the upper end portions of the adjacent bridge girder portions 1'.

That is, in the case where the bridge girder 1 is the H-beam bridge girder, the first flange 16A installed in a protruding manner to the one end portion 14*a* of the connecting plate 14 is engaged with the upper flange 1*b* of the one adjacent bridge girder portion 1', and the second flange 16B is engaged with the upper flange 1*b* of the other adjacent bridge girder portion 1', whereby the connecting plate 14 is bridged over the adjacent upper flanges 1*b*, and is connected with the connecting rods 13.

Further, as illustrated in FIGS. 7 to 11, the fitting convex portion 15A or the fitting concave portion 15B can be formed in the one end portion 14*a* and the other end portion 14*b* of the connecting plate 14 with the flanges, and can be fit into or fit with the fitting concave portion 15B or the fitting convex portion 15A formed in the upper flanges 1*b* of the adjacent bridge girder portion 1'.

Further, as illustrated in FIG. 13(B), the auxiliary connecting plate 17 having a similar configuration to the connecting plate 14 with the flanges, that is, the first flange portion 16A being installed in a protruding manner to the one end portion 17*a* and the second flange portion 16B being installed in a protruding manner to the other end portion 17*b*, and the auxiliary connecting plate 17 being bridged over the lower flanges 1*c* of the adjacent bridge girder portions 1' is arbitrarily performed according to implementation.

Figure 14A:
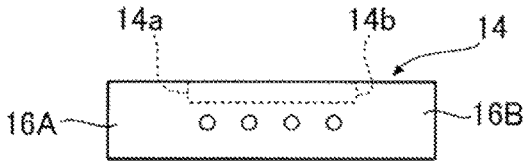
FIG. 14(A) is a plan view illustrating an example of the connecting plate formed by processing an L-beam.
Figure 14B:
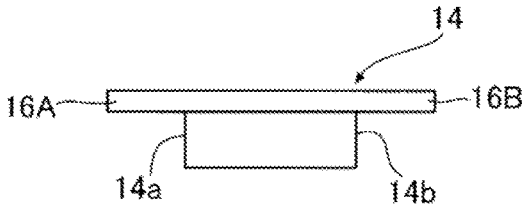
FIG. 14(B) is a side view of the connecting plate.
Figure 14C:
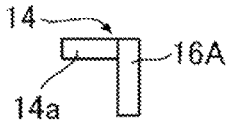
FIG. 14(C) is a front view of the connecting plate.
Figure 15A:
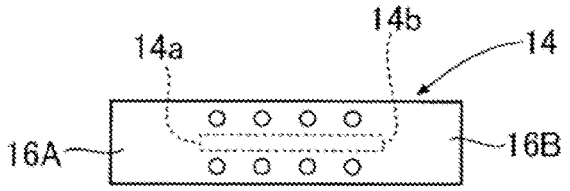
FIG. 15(A) is a plan view illustrating an example of the connecting plate formed by processing a T-beam.
Figure 15B:
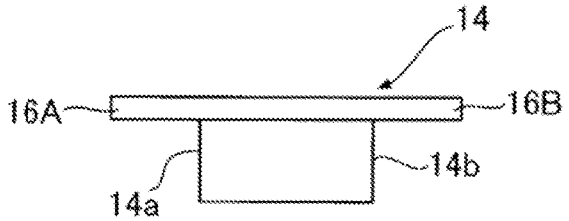
FIG. 15(B) is a side view of the connecting plate.
Figure 15C:
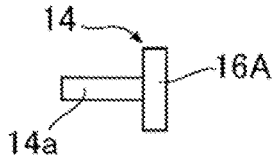
FIG. 15(C) is a front view of the connecting plate.

Further, the connecting plate 14 in FIGS. 14(A) to 14(C) illustrate an example of a processed and formed L-beam (angle bar), in which one of two steel plates connected at a right angle is partially cut off and the other is left as it is, and one end portion of the other steel plate is used as the first flange portion 16A and the other end portion is used as the second flange portion 16B. Further, the connecting plate 14 in FIGS. 15(A) to 15(C) illustrate an example of a processed and formed T-beam, in which a web plate is partially cut off and an upper flange is left as it is, and one end portion of the upper flange is used as the first flange portion 16A and the other end portion is used as the second, flange portion 16B. It is obvious that the connecting plates 14 with the flanges formed of these types of beams can connect the upper flanges 1*c* of the adjacent bridge girder portions 1', similarly to the connecting example of FIG. 13.

Figure 16A:
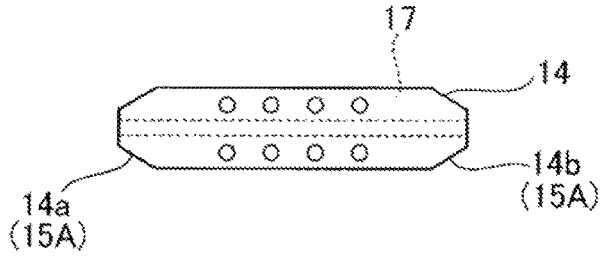
FIG. 16(A) is a plan view illustrating an example of the connecting plate and an auxiliary connecting plate formed by processing an I-beam.
Figure 16B:
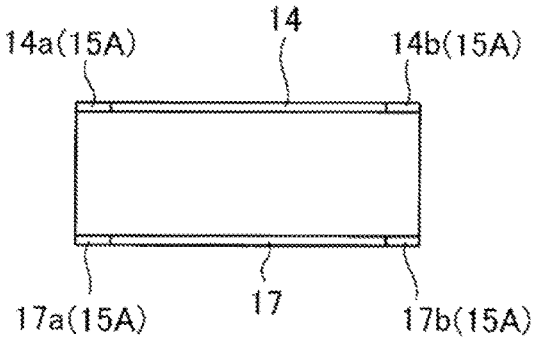
FIG. 16(B) is a side view of the connecting plate and the auxiliary connecting plate.
Figure 16C:
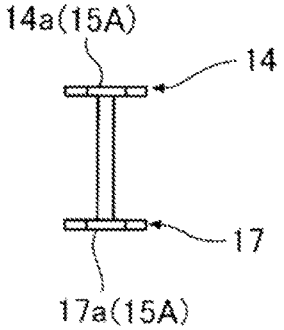
FIG. 16(C) is a front view of the connecting plate and the auxiliary connecting plate.

Further, FIGS. 16(A) to 16(C) illustrate an example in which the I-beam having the same height as the bridge girder 1 is processed, and an upper flange of the I-beam is used as the connecting plate 14, and a lower flange is used as the auxiliary connecting plate 17. That is, FIGS. 16(A) to 16(C) illustrate the connecting plate 14 and the auxiliary connecting plate 17 that are integrated through the web plate, and the connecting plate 14 and the auxiliary connecting plate 17 can more reliably and firmly connect the upper flanges 1*b* and the lower flanges 1*c* of the adjacent bridge girder portions 1'.

As described above, in the case where the bridge girder 1 is the H-beam bridge girder 1, the upper flanges 1*b* as the upper end portions of the adjacent bridge girder portions 1' are connected with the connecting plate 14, the connecting rods 13 embedded in the concrete pier 2 are inserted into the connecting plate 14, the stoppers such as the nuts 18 are provided to the upper-end projection portions of the inserted connecting rods 13, the stoppers are fastened to the upper surface of the connecting plate 14, the connected connecting plate 14 and connecting rods 13 are embedded in the connection concrete 12, whereby concrete joining between the slab concrete 3 and the bridge seat 2*a* of the concrete pier 2 that supports the bridge girder portions 1' through the connection concrete 12 is reinforced.

In addition, the lower flanges 1*c* as the lower end portions of the adjacent bridge girder portions 1' are connected with the auxiliary connecting plate 17, and the connecting rods 13 are inserted into the auxiliary connecting plate 17 to connect the upper and lower end portions of the adjacent bridge girder portions 1', whereby reinforcement of the concrete joining becomes reliable.

Similarly, in the cases of using T-beam bridge girder and the I-beam bridge girder made of steel material as the bridge girder 1, the upper flanges in the bridge girder portions 1' of the bridge girders 1 can be connected with the connecting plate 14. In the cases of using various types of concrete bridge girders as the bridge girder 1, the upper end portions of the girder bodies in the bridge girder portions 1' of the bridge girders 1 can be connected with the connecting plate 14. In any case, the concrete joining between the slab concrete 3 and the bridge seats 2*a* of the concrete piers 2 that support the bridge girder portions 1' can be reinforced.

Further, it is obvious that the lower end portions of the adjacent bridge girder portions 1' in the various types of concrete bridge girders such as the T-beam bridge girder and the I-beam bridge girder can be connected with the auxiliary connecting plate 17.

<Application Examples of Slab Bridge Structure According to Present Invention to Existing Bridges>

Figure 17A:
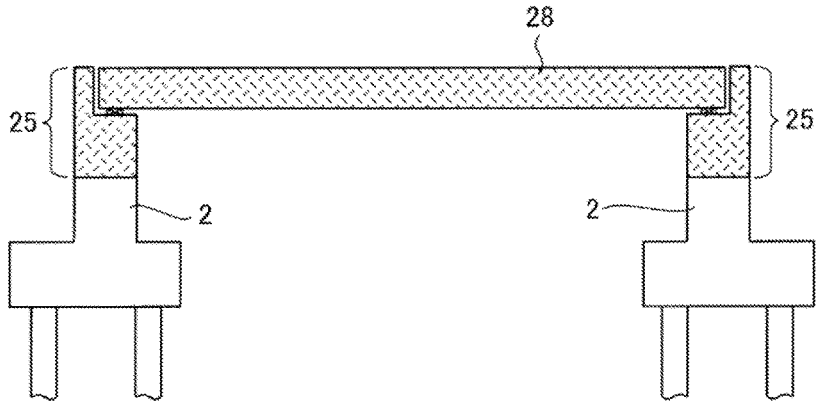
FIG. 17(A) is a side view schematically illustrating a portions demolished and removed from an existing bridge.
Figure 17B:
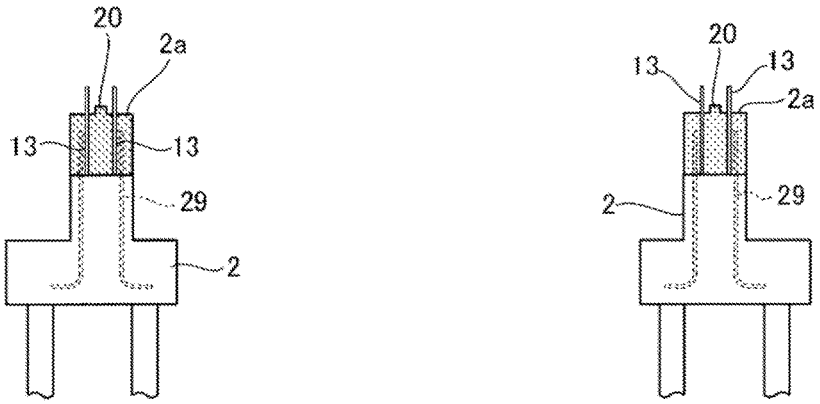
FIG. 17(B) is a side view schematically illustrating a process of newly pouring concrete to upper portions of existing concrete piers and embedding the connecting rods in the pour concrete.
Figure 18:
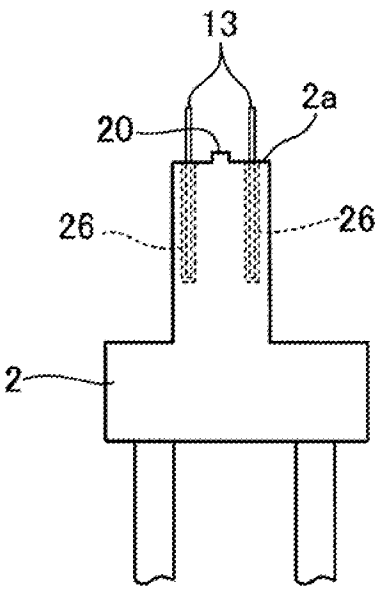
FIG. 18 is a side view schematically illustrating a process of demolishing and removing upper constructed portions of an existing bridge and embedding the connecting rods in existing concrete piers.
Figure 18:
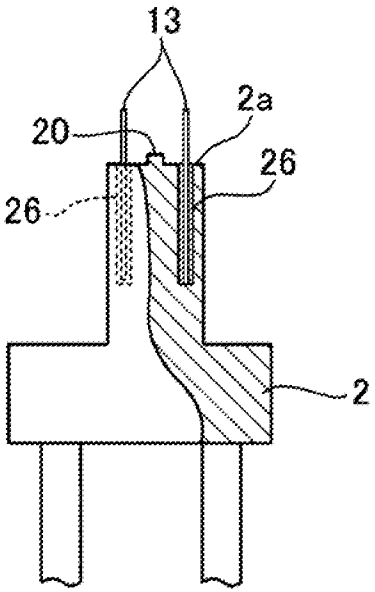

FIGS. 17 and 18 exemplarily illustrate a process of embedding the connecting rods 13 necessary for building the slab bridge structure in existing concrete piers 2 in the vertical direction, in applying the slab bridge structure according to the present invention to an existing bridge.

For example, as illustrated in FIG. 17(A), first, an upper constructed portion 28 of the existing bridge is demolished and removed, and solid wall portions 25 in upper portions of the concrete piers 2 are also demolished and removed. At this time, as illustrated in FIG. 17(B), only the concrete portions of the solid wall portions 25 are demolished and existing reinforcing bars 29 embedded in the concrete of the solid wall portions 25 are left as much as possible. Next, the existing reinforcing bars 29 are embedded in newly poured concrete. Then, the upper portions of the piers 2 are re-built with the poured concrete, and the connecting rods 13 are embedded in the concrete in the vertical direction so as to project upward from the bridge seats 2*a* formed on upper ends of the re-built portions.

Further, as illustrated in FIG. 18, in a case where the existing piers 2 do not have solid wall portions, only upper constructed portions are demolished and removed, and the existing piers 2 are used as they are. In this case, the bridge seats 2*a* of the existing piers 2 are drilled, the connecting rods 13 are inserted into holes 26 formed by the drilling and are caused to project from the bridge seats 2*a* of the piers 2 while being embedded in the piers 2 in the vertical direction through filling material or the like.

As described above, for the existing bridge, the upper constructed portion is removed, and the connecting rods 13 to be used for the slab bridge structure of the present invention can be easily provided using a part or all of the existing concrete piers 2 (lower constructed portions).

Therefore, the rest of the process is similar to new construction, and the rigid connection structure is obtained by directly or indirectly supporting the bridge girders 1 by the bridge seats 2*a* of the piers 2 while arranging the bridge girders 1 in line in the bridge width direction, pouring the slab concrete 3 between the side surfaces of the bridge girders 1 in the longitudinal direction of the bridge girders 1, further adding the connection concrete 12, in which the bridge girder portions 1' supported by the bridge seats 2*a* are embedded, to the bridge seats 2*a* of the bridge girders 2, and concrete-joining the slab concrete 3 and the concrete pier 2 through the connection concrete 12. Accordingly, the slab bridge structure according to the present invention can be built, in which the connecting plate 14 that connects the adjacent bridge girder portions 1' and the connecting rods 13 connected with the connecting plate 14 and embedded in the piers 2 reinforce the rigid connection structure in cooperation with each other.

Therefore, the slab bridge structure according to the present invention can be easily built while reusing the lower constructed portions of the existing bridge, and is very effective as reinforcing means or repairing means of the existing bridge.

As described above, as the slab bridge structure according to the present invention, the rigid connection structure is built by forming the slab 4 made of a composite structure of the bridge girders 1 arranged in line in the bridge width direction and supported by the concrete piers 2, and the slab concrete 3 formed throughout the longitudinal direction between the bridge girders 1, and concrete-joining the slab concrete 3 and the piers 2 through the connection concrete 12, in which the bridge girder portions 1' supported by the bridge seats 2*a* of the piers 2 are embedded.

Further, as means to reinforce the rigid connection structure, the connecting rods 13 embedded in the piers 2 and projecting upward from the bridge seats 2*a* of the piers 2, and the connecting plate 14 that connects the upper end portions of the adjacent bridge girder portions 1' are included. The connecting rods 13 and the connecting plate 14 reinforce the concrete joining with the connection concrete 12, and connects the bridge girder portions 1' of the bridge girders 1 and the concrete piers 2.

Note that the above-described embodiment has described the case of forming the slab concrete 3 in the total volume of the space between the adjacent bridge girders 1. However, the embodiment is not limited to the example, and does not obstruct pouring and forming the slab concrete 3 only in an upper space of the space between the adjacent bridge girders 1 throughout the bridge length direction without pouring the concrete in a lower space of the space, and leaving the lower space in the bridge length direction or filling the lower space with light weight material like foam material. In any case, the slab concrete 3 is continuous in the spans of the piers 2 and is integrally connected with the connection concrete 12 in both ends of the piers 2.

In the described embodiment, an abutment and a pier are collectively referred to as the term "pier 2".

REFERENCE SIGNS LIST

1 Bridge girder
1' Bridge girder portion
1*a* Web plate
1*b* Upper flange (upper end portion of bridge girder)
1*c* Lower flange (lower end portion of bridge girder)
2 Concrete pier
2*a* Bridge seat
3 Slab concrete
4 Slab
5 Upper opening
5' Lower opening
6 Roadbed concrete
7 Road pavement
8 and 8' Vertically installed reinforcing bar
9 Horizontally installed reinforcing bar
10 and 10' Hanged reinforcing bar
Inserting rod
12 Connection concrete
12*a* Top portion of connection concrete
12*b* Rear end portion of connection concrete
12*c* Bottom portion of connection concrete
12*d* Right and left side portions of connection concrete
13 Connecting rod
14 Connecting plate
14*a* One end portion of connecting plate
14*b* The other end portion of connecting plate
15A Fitting convex portion
15B Fitting concave portion
16A First flange
16B Second flange
17 Auxiliary connecting plate
17*a* One end portion of auxiliary connecting plate
17*b* The other end portion of auxiliary connecting plate
18 Nut
19 Sheet pile
20 Sleeper
21 Buried pile
22 Sheet pile connecting reinforcing bar
23 Narrow seat plate
24 Square seat plate
25 Solid wall portion of existing pier
26 Hole
27 Support member
28 Upper constructed portion of existing bridge
29 Existing reinforcing bar

The invention claimed is:

1. A slab bridge structure having a rigid connection structure in which slab concrete is poured between side surfaces of bridge girders arranged in line in a bridge width direction, throughout a longitudinal direction of the bridge girders, connection concrete in which bridge girder portions supported by a bridge seat of a concrete pier that supports the bridge girders are embedded is further added onto the bridge seat, and the slab concrete and the concrete pier are concrete joined through the connection concrete, the slab bridge structure further comprising:

a connecting rod embedded in the concrete pier and projecting upward from the bridge seat of the pier; and a connecting plate connecting upper end portions of the adjacent bridge girder portions, wherein an upper end projection portion of the connecting rod is inserted into the connecting plate, a stopper is provided on the upper-end projection portion of the connecting rod, and the stopper is fastened to an upper surface of the connecting plate to connect the bridge girders with the concrete pier.

2. The slab bridge structure according to claim 1, wherein the stopper is a nut screwed onto the upper-end projection portion of the connecting rod.

3. The slab bridge structure according to claim 1, wherein the upper end portions of the bridge girder portions of all the bridge girders are connected through the connecting plate.

4. The slab bridge structure according to claim 1, wherein the upper end portion of the bridge girder portion of the bridge girder is connected with the upper end portion of at least one other bridge girder portion through the connecting plate.

5. The slab bridge structure according to claim 1, wherein one end portion of the connecting plate is fit with the upper end portion of one adjacent bridge girder portion, and the other end portion of the connecting plate is fit with the upper end portion of the other adjacent bridge girder portion, to connect the upper end portions of the adjacent bridge girder portions.

6. The slab bridge structure according to claim 1, wherein a first flange is installed in a protruding manner in one end portion of the connecting plate and is engaged with the upper end portion of one adjacent bridge girder portion, and a second flange is installed in a protruding manner in the other end portion of the connecting plate and is engaged with the upper end portion of the other adjacent bridge girder portion, to connect the upper end portions of the adjacent bridge girder portions.

7. The slab bridge structure according to claim 1, wherein lower end portions of the bridge girder portions connected with the connecting plate is connected with an auxiliary connecting plate, and the connecting rod is inserted into the auxiliary connecting plate.

8. The slab bridge structure according to claim 1, wherein the concrete pier is supported by an upper end of a sheet pile.

9. The slab bridge structure according to claim 1, wherein a sleeper that supports the bridge girder is provided on the bridge seat of the concrete pier, and the sleeper is embedded in the connection concrete.

* * * * *